United States Patent [19]

Bienert et al.

[11] Patent Number: 4,986,253

[45] Date of Patent: Jan. 22, 1991

[54] HEAT PIPE CONVECTION OVEN

[75] Inventors: Walter B. Bienert, Lutherville; Edward J. Jopson, Baltimore, both of Md.; Richard J. Lanza, Leominster, Mass.

[73] Assignee: The United States of America as represented by the Secretary of the Army, Washington, D.C.

[21] Appl. No.: 441,725

[22] Filed: Nov. 27, 1989

[51] Int. Cl.[5] ..... F24C 15/32

[52] U.S. Cl. ..... 126/21 A; 126/19 R; 126/273 R; 165/104.17

[58] Field of Search ..... 126/21 A, 19 R, 273 R; 165/104.19, 104.21, 104.26, 47

[56] References Cited

U.S. PATENT DOCUMENTS 3,948,244 4/1976 Lazaridis et al. ..... 126/19 R 4,785,875 11/1988 Meijer et al. ..... 165/104.26

*Primary Examiner*—Larry Jones

*Attorney, Agent, or Firm*—Richard J. Donahue; Lawrence E. Labadini

[57] ABSTRACT

A baking oven utilizes a vapor chamber for at least three of its six inside walls. A vaporized heat transfer medium is circulated through the walls of the oven to provide a more uniform temperatrure distribution throughout the oven.

10 Claims, 2 Drawing Sheets

HEAT PIPE CONVECTION OVEN

The invention described herein may be manufactured, used and licensed by or for the Government for Governmental purposes without the payment to us of any royalty thereon.

BACKGROUND OF THE INVENTION

This invention relates in general to an improved oven for baking and, more particularly, to an oven which uses a heat exchanger to achieve more uniform baking temperatures.

In conventional fuel-fired convection ovens combustion gases are ducted over the outside of one or more of the enclosing walls of the oven cavity. An internal blower is often provided to circulate the air over the food and into contact with the heated walls. Although this type of oven is adequate to transfer sufficient heat from the combustion gases to the oven cavity, uniformity of baking is often a problem because the temperature of the oven walls varies significantly. This results in overbaking of food products located immediately adjacent a heated wall and underbaking of food products adjacent an unheated wall. It is desirable to have a baking oven which uniformly bakes all of the food products.

SUMMARY OF THE INVENTION

It is a principal object of the invention to provide a fuel-fired convection oven which uniformly bakes food products.

Another object of the invention to provide a convection oven in which at least three of the side walls of the oven cavity are heated to a uniform temperature to thereby achieve uniform baking temperatures throughout the oven cavity.

Upon further study of the specification and appended claims, further objects and advantages of this invention will become apparent to those skilled in the art.

These objects are attained by passing a vaporized heat transfer medium inside and through at least three of the hollow walls which form the oven cavity. Upon coming into contact with the cooler walls of the oven, the vapor condenses at one temperature resulting in more uniform heating of the oven walls. Combustion products from a fuel-fired combustion chamber pass through a heat exchanger in heat exchange relationship with a liquid heat transfer medium. In a preferred embodiment, the combustion products discharging from the heat exchanger are passed in heat exchange relationship with the outside of one of the hollow walls which form the oven cavity. The hollow walls form a vapor chamber into which the heat transfer medium is circulated from the heat exchanger. The vaporized heat transfer medium passes throughout all three of the hollow oven walls, condenses, and the liquid condensate drains through the vapor chambers and back to the heat exchanger where it is reheated by hot gases from the combustion chamber.

In a preferred embodiment, a helical heat exchanger is used to heat the heat transfer medium. Combustion gases from the fuel-fired burner are passed around the spiral pathway of the helical heat exchanger, the liquid heat transfer medium being circulated inside the plates which form the helical heat exchanger.

BRIEF DESCRIPTION OF FIGURES

The invention and further details of the invention will become more apparent from the examples of embodiments presented hereinafter and illustrated schematically.

DETAILED DESCRIPTION

Figure 1:
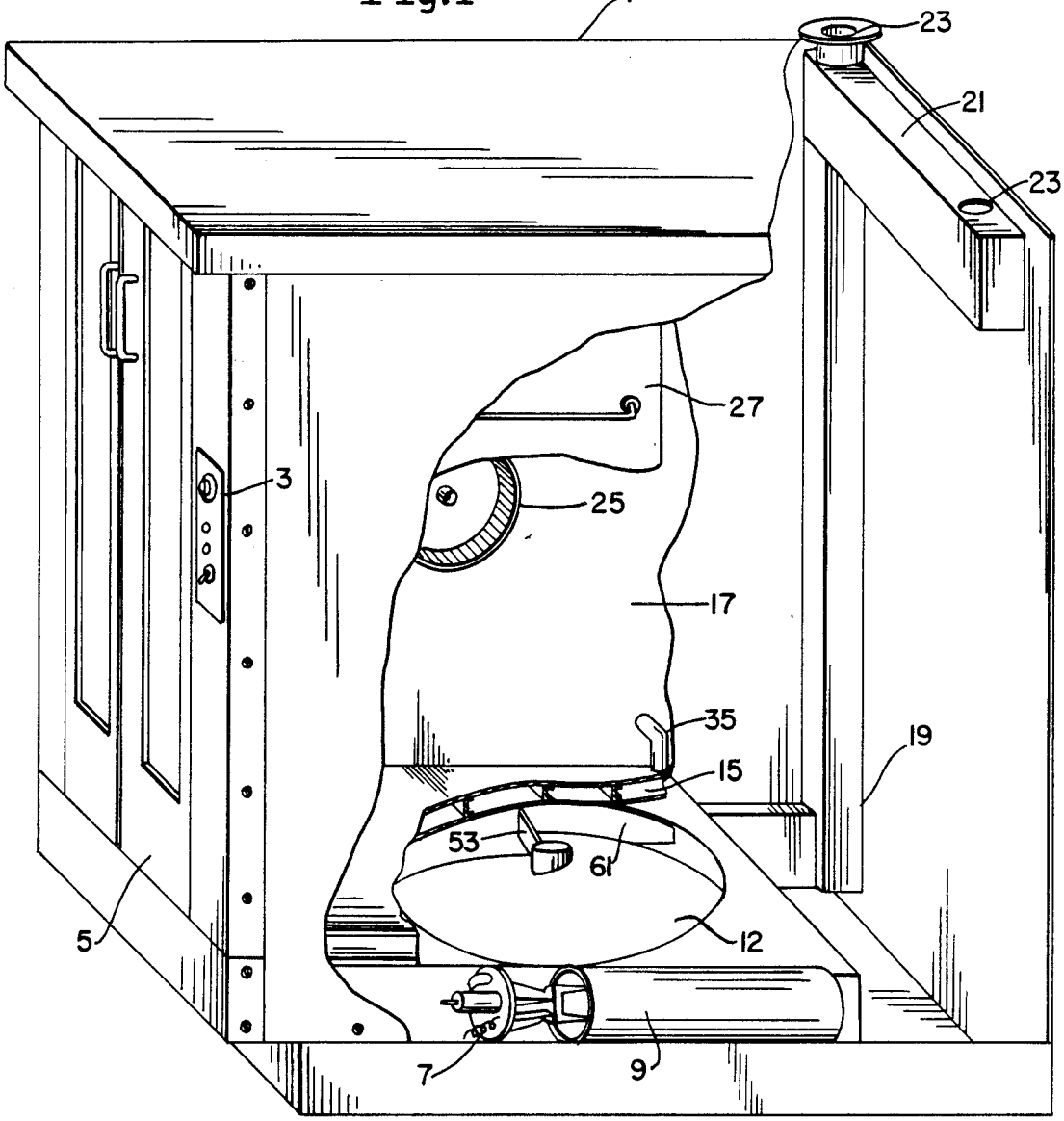
FIG. 1 is a perspective view partially cut away of the oven of the present invention.

Referring to the drawings, FIG. 1 shows the oven 1 of the present invention with a front central panel 3 next to access door 5. Shown in the cutaway portion of FIG. 1 is the burner 7 and combustion chamber 9 located at the bottom of the oven. Preferably, an access door (not shown) for servicing is provided on the outside of the oven. Heat exchanger 12 is located below the oven cavity immediately below the bottom of a primary vapor chamber 15. The vapor chamber forms the inside bottom wall of the oven cavity. At least two other vapor chambers form the inside walls of the oven cavity. In FIG. 1, the vapor chamber 17 forms one of the side walls of the oven cavity. Combustion gases from burner 7 are discharged through exhaust duct 19 and into manifold 21. Two optional exhaust ports 23 are provided on the right or left sides of manifold 21.

In a preferred embodiment, forced convection inside the oven is provided by at least one fan 25. When two fans are used, each is preferably driven by a separate motor. Food trays are supported by rack holders 27 which are attached to the inside walls of the oven.

Figure 2:
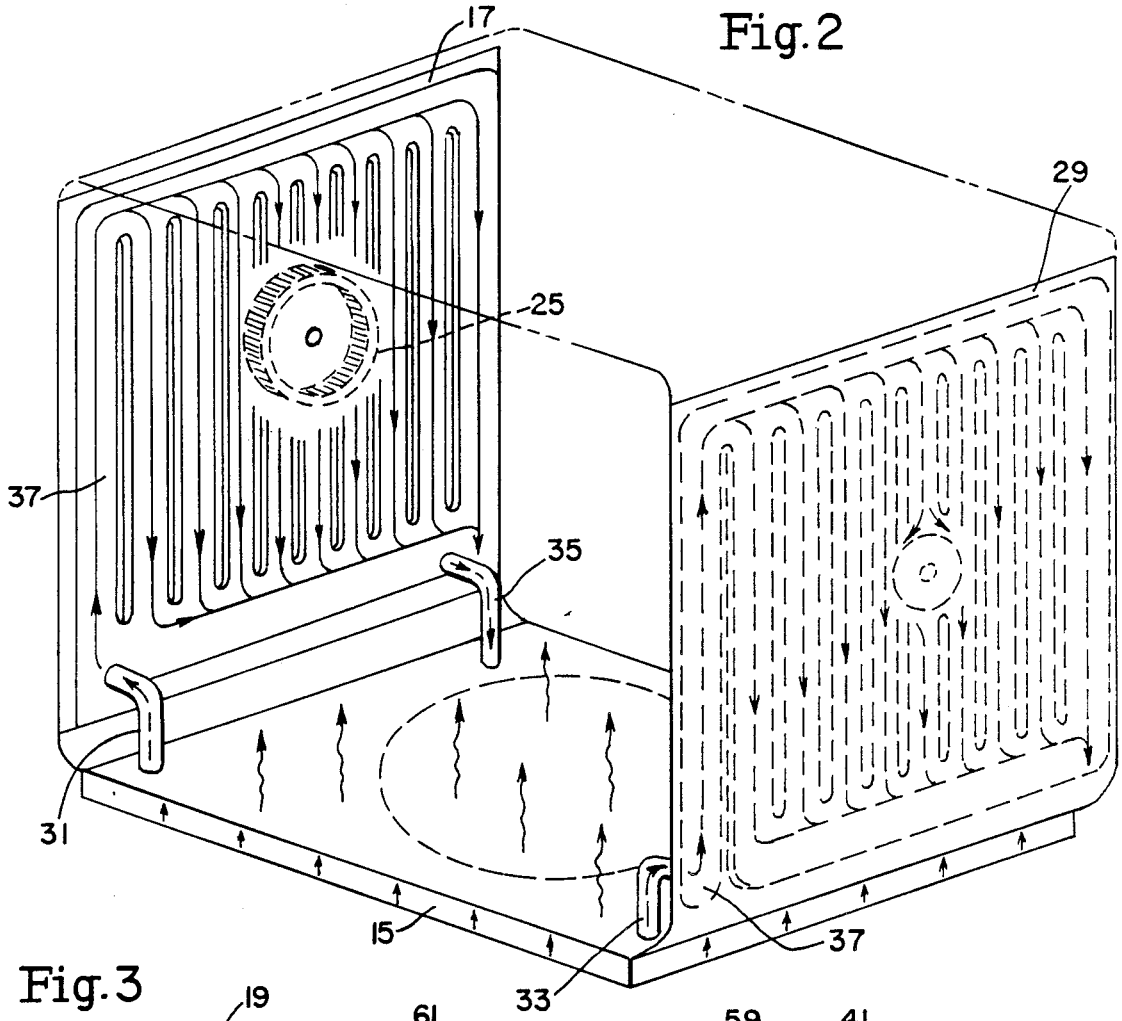
FIG. 2 is a perspective view of the vapor chamber forming the walls of the oven cavity.

The vapor chambers shown in FIG. 2 consist of three parts, the primary vapor chamber 15, side wall vapor chamber 17, and side wall vapor chamber 29. The primary vapor chamber 15 is a sealed box type structure which is evacuated and then partially filled with a liquid heat transfer medium. In a preferred embodiment, Dowtherm A, a product of Dow Chemical Corp., is used as the heat transfer medium. However, any type of fluid heat transfer medium can be used which normally vaporizes at the temperatures used in the heat exchanger 12 and which is normally in the liquid phase at the baking temperatures. Vapor inlet lines 31 and 33 connect vapor chamber 15 to the vapor chambers 17 and 29, respectively. Condensate return line 35 connects vapor chamber 17 with vapor chamber 15. A similar condensate return line (not shown) connects vapor chamber 15 and 29.

In another preferred embodiment, the vapor chambers 17 and 29 are formed by laminated metal plates which have been embossed with fluid channels 37. These so-called panel coils are flat on one side (the outside of the oven cavity) and are embossed on the other side.

This arrangement improves the heat transfer characteristics of the panels inside of the oven. The panels may have a debossed area near their center where the drive shaft of a fan extends through the panel coil.

Figure 3:
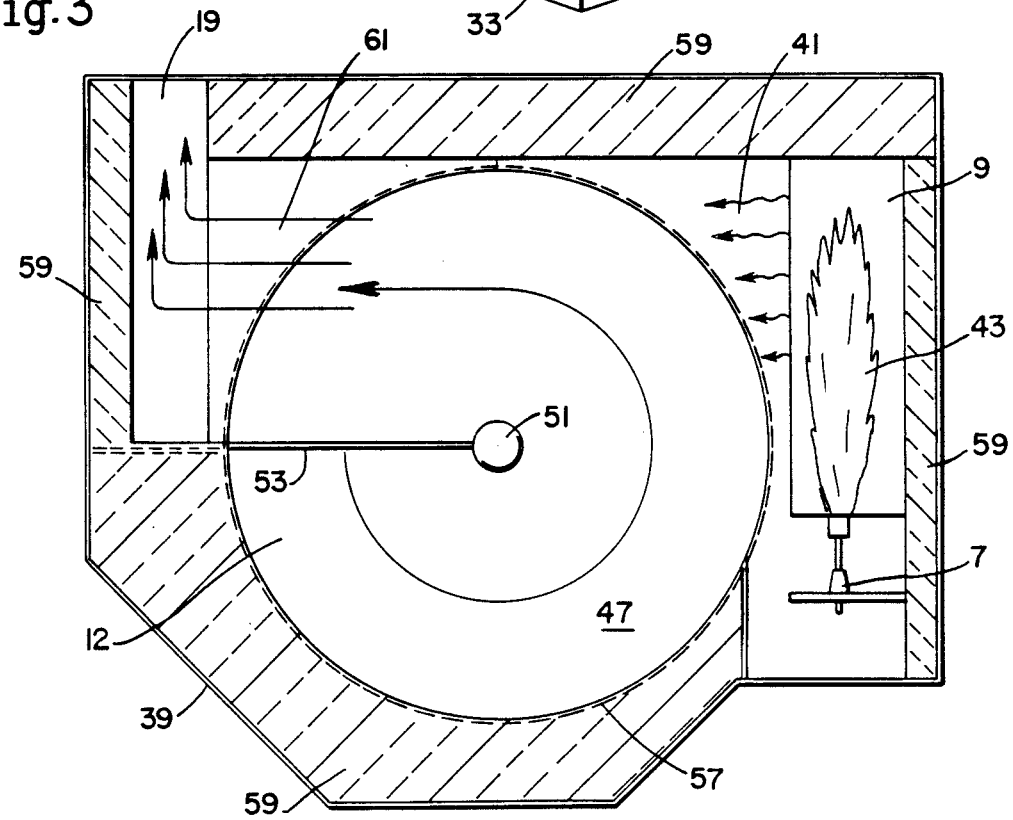
FIG. 3 is a top view of the burner combustion chamber of the heat exchanger unit.

In a preferred embodiment, the burner 7, combustion chamber 9, and heat exchanger 12 are a single assembly or unit 39 as shown in FIG. 3. The assembly 39 is attached to the bottom of the vapor chamber 15 and can be removed in its entirety for inspection and cleaning. The combustion chamber consists of a tube perforated on one side to permit combustion gases 41 from flame 43 to exit into heat exchanger 12. In a preferred embodiment, the combustion chamber 9 is fabricated from a low-density, high-temperature refractory material.

Figure 4:
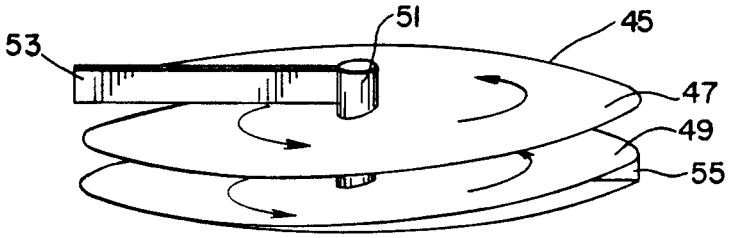
FIG. 4 is a perspective view of the core of the heat exchanger.

In another preferred embodiment, the heat exchanger core 45 shown in FIG. 4 is a helix consisting of several hollow plates 47 and 49 through which a liquid heat transfer medium circulates. A central line 51 extending between plates 47 and 49 of the helix core 45 carries the liquid heat transfer medium from vaporizer chamber 15 throughout the entire core 45. The liquid heat transfer medium enters line 51 through line 53 and discharges from line 55 which is connected to the lowermost helical plate 49. The heat transfer medium then flows through a line (not shown) from the line 55 to the bottom of vapor chamber 15 where it is partially vaporized.

A circulate plate 57 (shown by a dotted line in FIG. 3) surrounds the heat exchanger core. Plate 57 is provided with ports to permit the flow of combustion gases into and out of core 45. A heat transfer insulation 59 shown as a shaded area surrounds the entire combustion chamber and heat exchanger. In a preferred embodiment, the core 45 and surrounding wall 57 are formed from high temperature alloy sheet material.

In operation, combustion gases 41 discharging from combustion chamber 9 at a temperature of approximately 2,000° F. enter heat exchanger core 45 between lowermost plates 47 and 49. The gases 41 enter at the bottom and swirl upwardly round the helical path and exit near the top. During the last pass around core 45, the combustion gases contact a portion of the bottom surface of vapor chamber 15. In a preferred embodiment, the combustion gases make about two and one-half circular turns through core 45 before exiting at 61 through exhaust duct 19 in manifold 21.

The liquid heat transfer medium flows from the bottom of vapor chamber 15 through line 53 and then line 51 into the interior of the helical plates 47 and 49, and exits through line 55 which connects (not shown) to vapor chamber 15.

Boiling fluid is then vaporized, and the resulting vapor rises through vapor lines 31 and 33 and flows throughout the vapor chambers 15, 17, and 29. This vapor condenses as it contacts the three inside walls of the oven cavity, resulting in at least three isothermal walls in the oven. The resulting condensate flows downwardly through the parallel passages of the panel coils, through condensate return line 35 and into the sump of the primary vapor chamber 15. Tests of the above-described oven have demonstrated that this type of heat exchanger provides a uniform heat flux into the vapor chamber. The heat transfer mechanisms are convective from the combusion gases 41 during their last pass, and radiation from the heat exchanger core 47.

An oven was constructed according to this invention to determine the uniformity of heating. This oven was tested with various food products, such as white cake and pizza. During a typical test run an oven constructed according to this invention was loaded with six white cakes after it had been preheated. During the baking period the wall temperatures ranged from 569° F. to 581° F. and the cavity temperature was uniform to within ± 15° F. The weight loss (due to evaporation) for these cakes ranged from 280 to 360 g. Test runs with pizza yielded similar results.

The preceding examples can be repeated with similar success by substituting the generically or specifically described apparatus and/or operating conditions of this invention for those used in the preceding examples.

From the foregoing description, one skilled in the art can easily ascertain the essential characteristics of this invention and without departing from the spirit and scope thereof, can make various changes and modifications of the invention to adapt it to various usages and conditions.

We claim:

1. A convection oven for baking at uniform temperatures comprising: (a) an oven cavity, (b) a fuel-fired burner and combustion chamber, (c) a heat exchanger through which flows combustion products from the combustion chamber, said heat exchanger being in the form of a helix around which the combustion gases swirl upwardly in heat exchange relationship with a liquid heat transfer medium contained inside the helix, and (d) a vapor chamber which forms the bottom and at least two inside walls of the oven cavity, said vapor chamber being in communication with and receiving heat transfer medium from the heat exchangers.

2. The oven of claim 1, wherein the combustion gases passing upwardly through the heat exchanger contact the bottom surface of the vapor chamber which forms the bottom of the oven.

3. The oven of claim 1, wherein the vapor chamber making up at least two side walls are connected to the vapor chamber at the bottom of the oven by a vapor inlet line and a condensate return line.

4. A heat exchanger for use in a baking oven comprising: a helical-shaped heater core formed of a plurality of circular plates, a wall extending around the core to confine gases to the helical pathway formed by the core, a liquid inlet, a line extending between the plates through which a heat transfer fluid passes to the plates, and a combustion gas inlet at one end of the helix which directs combustion gases into and around the helical core.

5. The heat exchanger of claim 4, wherein the heat exchanger is high temperature alloy sheet material.

6. The heat exchanger of claim 4, wherein the combustion gas inlet is at the lower end of the helical core, and the line carrying the heat transfer medium through the core exits at the periphery of the lowermost plate.

7. A convection oven for baking at uniform temperatures comprising:

an oven cavity, a fuel-fired burner and combustion chamber, a heat exchanger through which flows combustion products from the combustion chamber, said heat exchanger containing a liquid heat transfer medium which is vaporized by the combustion products, said heat exchanger being in the form of a helix around which the combustion products whirl upwardly in heat exchange relationship with liquid heat transfer medium contained inside the helix, and a vapor chamber which forms the bottom and at least two side walls of the oven cavity, said vapor chamber being in communication with and receiving a heat transfer medium from the heat exchanger.

8. A convection oven for baking at uniform temperatures comprising:

an oven cavity, a fuel-fired burner and combustion chamber, a heat exchanger through which flows combustion products from the combustion chamber, said heat exchanger containing a liquid heat transfer medium which is vaporized by be combustion products, and a vapor chamber which forms the bottom and at least two side walls of the oven cavity, said vapor chamber being in communication with and receiving a heat transfer medium from the heat exchanger, the primary part of said vapor chamber forming the bottom of the oven being evacuated before being partially filled with a liquid heat transfer medium, said two side walls having a vapor chamber therein being formed of laminated plates with embossed channels through which vapor and condensate flow.

9. The oven of claim 8, wherein said channels are connected to the primary vapor chamber by a vapor inlet line and a condensate return line.

10. The oven of claim 8, wherein the side walls having vapor chambers therein are flat on the outside and embossed on the inside.

* * * * *